US008317596B2

(12) United States Patent
Allen et al.

(10) Patent No.: US 8,317,596 B2
(45) Date of Patent: Nov. 27, 2012

(54) EVENT-BASED SCHEDULING OF WAGERING GAME EVENTS

(75) Inventors: Jeff Allen, Naperville, IL (US); Christopher W. Blackburn, Reno, NV (US); Matthew J. Ward, Northbrook, IL (US); Larry Pacey, Chicago, IL (US)

(73) Assignee: WMS Gaming Inc., Waukegan, IL (US)

( * ) Notice: Subject to any disclaimer, the term of this patent is extended or adjusted under 35 U.S.C. 154(b) by 261 days.

(21) Appl. No.: 12/742,376

(22) PCT Filed: Nov. 11, 2008

(86) PCT No.: PCT/US2008/083106

§ 371 (c)(1),
(2), (4) Date: May 11, 2010

(87) PCT Pub. No.: WO2009/062201

PCT Pub. Date: May 14, 2009

(65) Prior Publication Data

US 2011/0105219 A1 May 5, 2011

Related U.S. Application Data

(60) Provisional application No. 60/987,096, filed on Nov. 11, 2007, provisional application No. 61/041,047, filed on Mar. 31, 2008.

(51) Int. Cl.
*A63F 9/24* (2006.01)

(52) U.S. Cl. ..... 463/20; 463/16; 463/25; 463/27; 463/29

(58) Field of Classification Search ..... None
See application file for complete search history.

(56) References Cited

U.S. PATENT DOCUMENTS

| | | | | |
|---|---|---|---|---|
| 6,676,521 | B1 | 1/2004 | La Mura et al. | |
| 7,857,699 | B2 * | 12/2010 | Baerlocher | 463/27 |
| 2005/0096121 | A1 * | 5/2005 | Gilliland et al. | 463/20 |
| 2006/0121971 | A1 * | 6/2006 | Slomiany et al. | 463/16 |
| 2006/0135243 | A1 | 6/2006 | Englman et al. | |
| 2006/0287043 | A1 | 12/2006 | Englman et al. | |
| 2007/0167210 | A1 * | 7/2007 | Kelly et al. | 463/16 |

OTHER PUBLICATIONS

"International Application Serial No. PCT/US2008/083106, Search Report mailed Dec. 29, 2008", 4 pgs.
"International Application Serial No. PCT/US2008/083106, Written Opinion mailed Dec. 29, 2008", 7 pgs.

* cited by examiner

*Primary Examiner* — Omkar Deodhar
(74) *Attorney, Agent, or Firm* — Schwegman Lundberg & Woessner, P.A.

(57) ABSTRACT

Wagering game systems and methods are disclosed in which the occurrence of a triggering event causes a community game to begin. Further, the occurrence of an event may cause a wagering game or wagering game service such as a progressive game to be reconfigured.

18 Claims, 7 Drawing Sheets

EVENT-BASED SCHEDULING OF WAGERING GAME EVENTS

RELATED APPLICATIONS

This patent application is a U.S. National Stage Filing under 35 U.S.C. 371 from International Patent Application Serial No. PCT/US2008/083106, filed Nov. 11, 2008, and published on May 14, 2009, as WO 2009/062201 A1, which claims the priority benefit of U.S. Provisional Patent Application Ser. No. 60/987,096 filed Nov. 11, 2007 and entitled "EVENT-BASED SCHEDULING OF WAGERING GAME EVENTS," and U.S. Provisional Patent Application Ser. No. 61/041,047 filed Mar. 31, 2008 and entitled "EVENT-BASED SCHEDULING OF WAGERING GAME EVENTS," the contents of which are incorporated herein by reference in their entirety.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2007, 2008, WMS Gaming, Inc.

FIELD

Embodiments of the inventive subject matter relate generally to wagering game systems, and more particularly, scheduling wagering game events based on the detection of triggering events.

BACKGROUND

Wagering game machine makers continually provide new and entertaining games. One way of increasing entertainment value associated with casino-style wagering games (e.g., video slots, video poker, video black jack, and the like) includes offering a variety of base games and bonus events. However, despite the variety of base games and bonus events, players often lose interest in repetitive wagering gaming content. In order to maintain player interest, wagering game machine makers frequently update wagering game content with new game themes, game settings, bonus events, game software, and other electronic data.

BRIEF DESCRIPTION OF THE FIGURES

Embodiments of the invention are illustrated by way of example and not limitation in the Figures of the accompanying drawings in which.

DESCRIPTION OF THE EMBODIMENTS

Example Operating Environment

Example Wagering Game Machine Architecture

Figure 1:
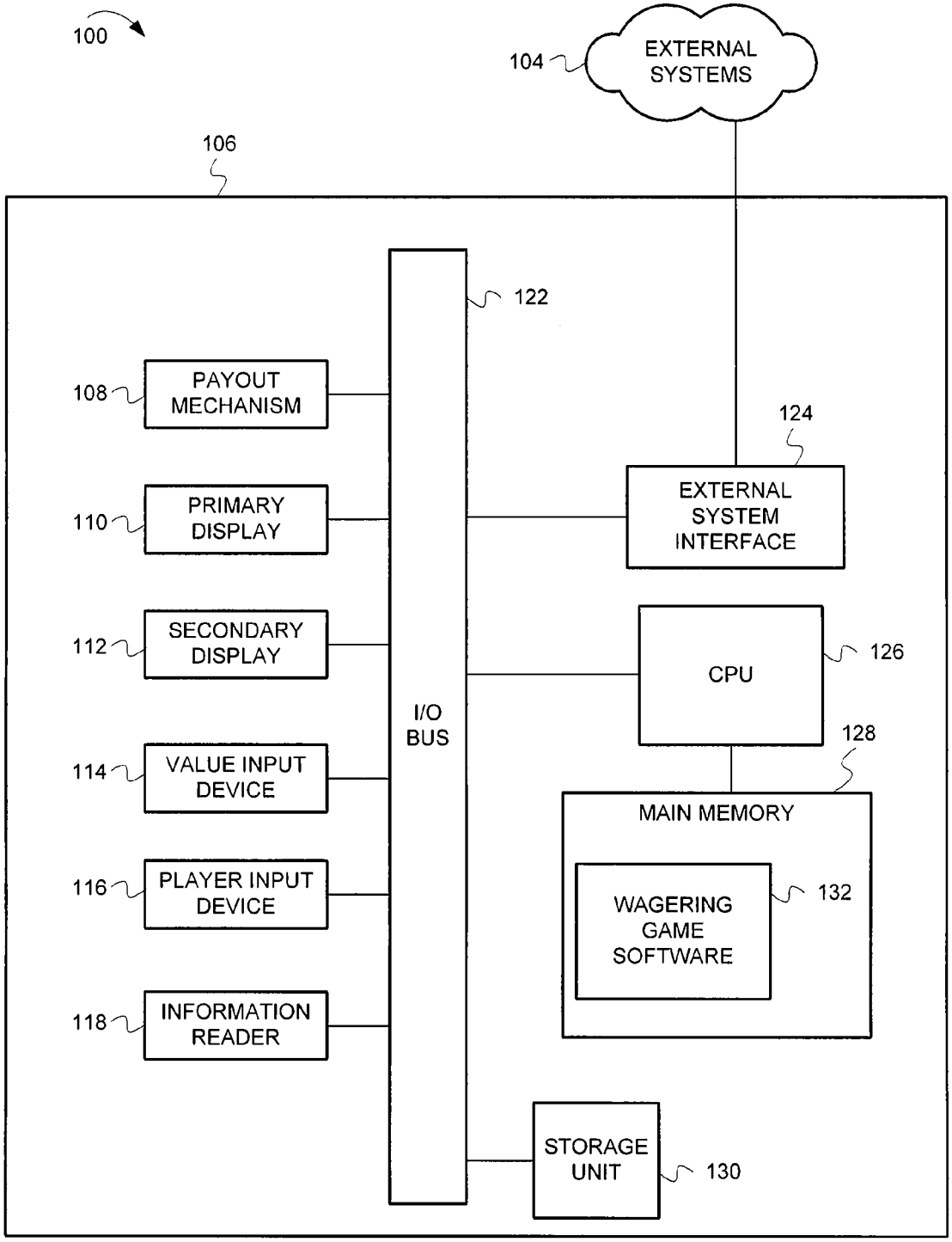
FIG. 1 is a block diagram illustrating a wagering game machine, including a control system, according to example embodiments of the invention.

FIG. 1 is a block diagram illustrating a wagering game machine architecture, including a control system, according to example embodiments of the invention. As shown in FIG. 1, the wagering game machine 106 includes a central processing unit (CPU) 126 connected to main memory 128, which includes wagering game software 132. In one embodiment, the wagering game software 132 can present wagering games, such as video poker, video black jack, video slots, video lottery, etc., in whole or part.

The CPU 126 is also connected to an input/output (I/O) bus 122, which facilitates communication between the wagering game machine's components. The I/O bus 122 is connected to a payout mechanism 108, primary display 110, secondary display 112, value input device 114, player input device 116, information reader 118, and storage unit 130. The player input device 116 can include the value input device 114 to the extent the player input device 116 is used to place wagers. The I/O bus 122 is also connected to an external system interface 124, which is connected to external systems 104 (e.g., wagering game networks).

In one embodiment, the wagering game machine 106 can include additional peripheral devices and/or more than one of each component shown in FIG. 1. For example, in one embodiment, the wagering game machine 106 can include multiple external system interfaces 124 and multiple CPUs 126. In one embodiment, any of the components can be integrated or subdivided. Additionally, in one embodiment, the components of the wagering game machine 106 can be interconnected according to any suitable interconnection architecture (e.g., directly connected, hypercube, etc.).

In one embodiment, any of the components of the wagering game machine 106 can include hardware, firmware, and/or software for performing the operations described herein. Machine-readable media includes any mechanism that provides (e.g., stores and/or transmits) information in a form readable by a machine (e.g., a wagering game machine, computer, etc.). For example, tangible machine-readable media includes read only memory (ROM), random access memory (RAM), magnetic disk storage media, optical storage media, flash memory machines, etc. Machine-readable media also includes any media suitable for transmitting software over a network.

Figure 2:
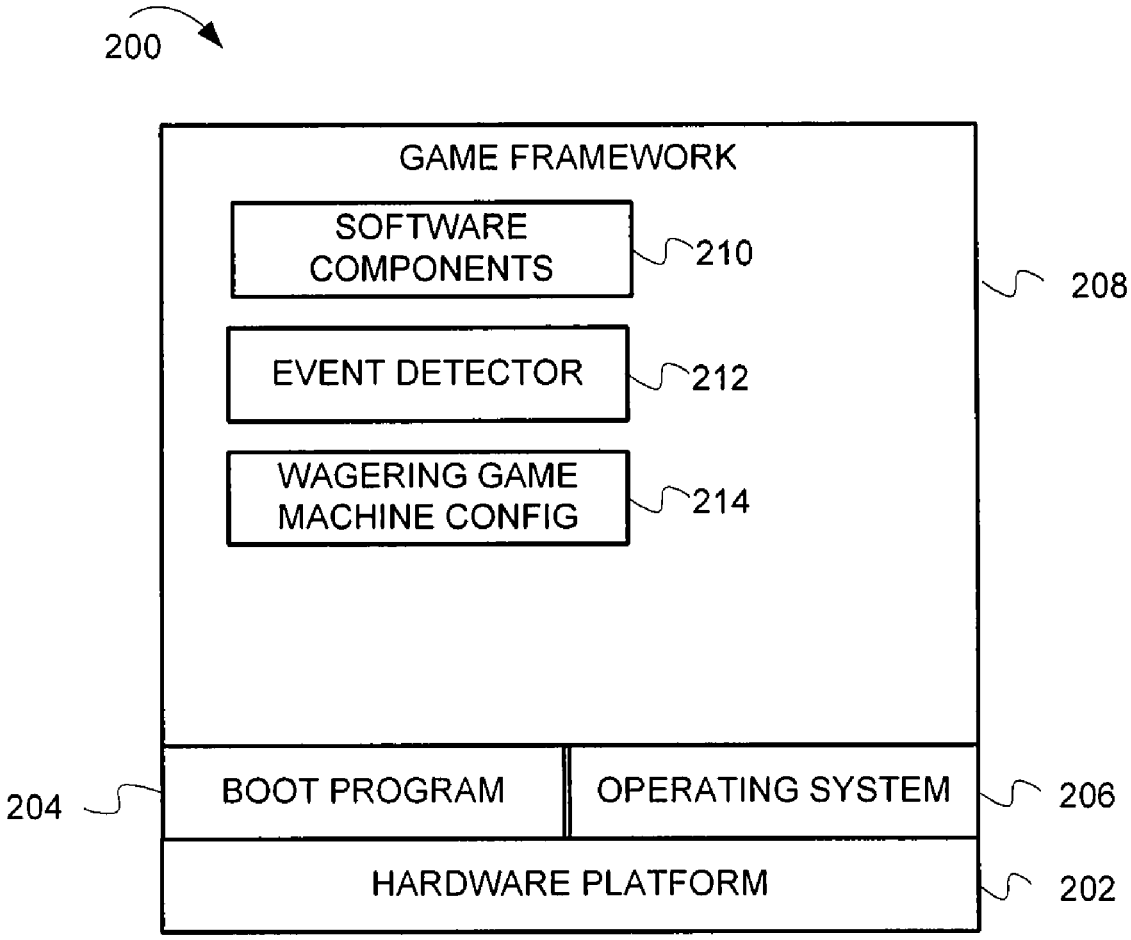
FIG. 2 is a block diagram illustrating a wagering game machine software and hardware architecture according to example embodiments of the invention.

FIG. 2, is a block diagram of an architecture for a wagering game machine 200, according to example embodiments of the inventive subject matter. As shown in FIG. 2, the wagering game architecture includes a hardware platform 202, a boot program 204, an operating system 206, and a game framework 208. In various embodiments, the hardware platform 202 may include a thin-client, thick-client, or some intermediate derivation. The hardware platform 202 may also be configured to provide a virtual client. The boot program 204 may include a basic input/output system (BIOS) or other initialization program that works in conjunction with the operation system 206 to provide a software interface to the hardware platform 202.

The game framework 208 may include standardized game software components 210, an event detector 212, wagering game machine configuration 214 and wagering game parameters 216. Game components 210 may be include either independent or in combination with specialized or customized game software components that are designed for a particular wagering game. In one example embodiment, the wagering game software components 210 may include software operative in connection with the hardware platform 202 and operating system 206 to present wagering games, such as video poker, video black jack, video slots, video lottery, etc., in whole or part. According to another example embodiment, the software components 210 may include software operative to accept a wager from a player. One or more of the software components 210 may be provided as part of the operating system 206 or other software used in the wagering game system 200 (e.g., libraries, daemons, common services, etc.).

Event detector 212 is a component that operates on a wagering game machine and is configured to detect one or more events that occur on a wagering game machine. The event detector 212 may be a component that is part of a wagering game, or it may be a component that executes independently of a wagering game. The event detector may send event data to a server for evaluation, or the event detector may cause reconfiguration of a wagering game machine without the aid of a server.

Wagering game machine configuration 214 may include a variety of configuration data that affects either the appearance of the wagering game machine, the appearance of a wagering game being presented on the wagering game machine, the operation of a wagering game, or services available on the wagering game machine. In some embodiments, configuration data that affects the appearance of a wagering game machine may include "skins", that is, graphics that are presented on various displays of the wagering game machine. Further, advertising that is presented on the wagering game machine or on overhead signage attached to or near the wagering game machine may be configured.

Configuration data that affects the appearance of a wagering game may include skins (e.g. graphics) associated with a wagering game. For example, a wagering game may have a number of different themes associated with it. Graphics for each theme may vary and may be displayed depending on what theme is currently configured. Similarly, a progressive game may have a number of skins that may be configured. Graphics associated with a wagering game may be configured, such as the look of reels or other symbols presented by a wagering game. Graphics associated with a bonus game associated with a wagering game may be configured.

Configuration data that affects the operation of the wagering game may include denomination data for the wagering game, one or more pay tables for the wagering game, the number of levels for a progressive game in which the wagering game is participating or the reset value for a progressive game.

Configuration data may be used to determine which services are made available on a wagering game machine and/or how those services operate. For example, email services, browser services, phone services and data services (weather, shows, traffic, sports, news etc.) may be provided on a wagering game machine. Configuration data may be used to determine which, if any, of these services are made available. Configuration data may be used to determine available or unlocked episodes of a wagering game or bonus game, available themes, or other assets on the wagering game machine. Additionally, an availability of a portal game service may be configured.

In addition, a player tracking service (not shown) may operate in conjunction with the wagering game machine.

Figure 3:
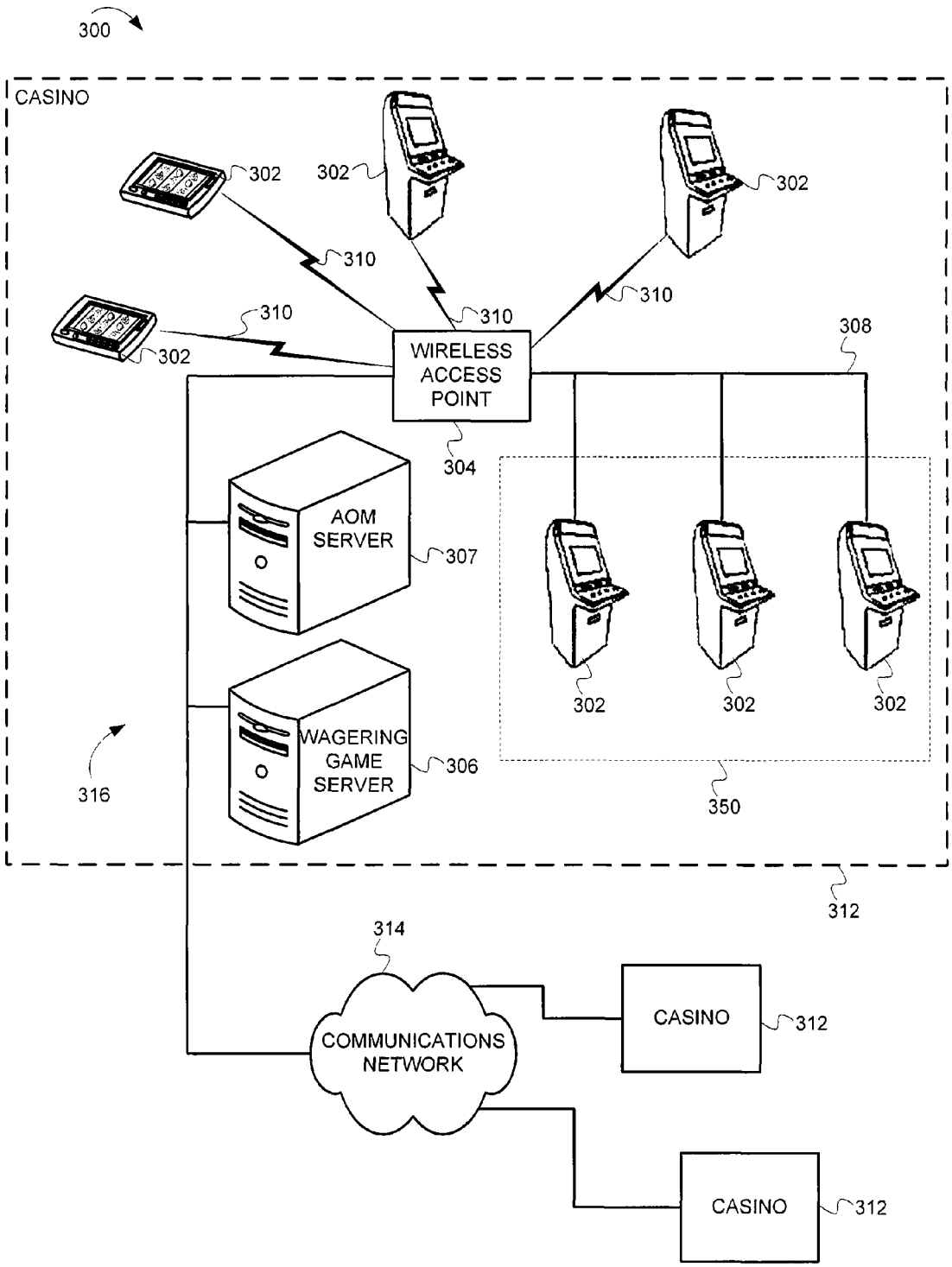
FIG. 3 is a block diagram illustrating a wagering game network, according to example embodiments of the invention.

While FIGS. 1 and 2 describe example embodiments of a wagering game machine architecture, FIG. 3 shows how a plurality of wagering game machines can be connected in a wagering game network.

Example Wagering Game Network

FIG. 3 is a block diagram illustrating a wagering game network 300, according to example embodiments of the invention. As shown in FIG. 3, the wagering game network 300 includes a plurality of casinos 312 connected to a communications network 314.

Each of the plurality of casinos 312 includes a local area network 316, which may include a wireless access point 304, wagering game machines 302, and a wagering game server 306 that can serve wagering games over the local area network 316. As such, the local area network 316 includes wireless communication links 310 and wired communication links 308. The wired and wireless communication links can employ any suitable connection technology, such as Bluetooth, 802.11, Ethernet, public switched telephone networks, SONET, etc. In one embodiment, the wagering game server 306 can serve wagering games and/or distribute content to devices located in other casinos 312 or at other locations on the communications network 314.

The wagering game machines 302 and wagering game server 306 can include hardware and machine-readable media including instructions for performing the operations described herein.

The wagering game machines 302 described herein can take any suitable form, such as floor standing models, handheld mobile units, bartop models, workstation-type console models, etc. Further, the wagering game machines 302 can be primarily dedicated for use in conducting wagering games, or can include non-dedicated devices, such as mobile phones, personal digital assistants, personal computers, etc. In one embodiment, the wagering game network 300 can include other network devices, such as accounting servers, wide area progressive servers, player tracking servers, and/or other devices suitable for use in connection with embodiments of the invention.

In various embodiments, wagering game machines 302 and wagering game servers 306 work together such that a wagering game machine 302 may be operated as a thin, thick, or intermediate client. For example, one or more elements of game play may be controlled by the wagering game machine 302 (client) or the wagering game server 306 (server). Game play elements may include executable game code, lookup tables, configuration files, game outcome, audio or visual representations of the game, game assets or the like. In a thin-client example, the wagering game server 306 may perform functions such as determining game outcome or managing assets, while the wagering game machine 302 may be used merely to present the graphical representation of such outcome or asset modification to the user (e.g., player). In a thick-client example, game outcome may be determined locally (e.g., at the wagering game machine 302) and then communicated to the wagering game server 306 for recording or managing a player's account.

Similarly, functionality not directly related to game play may be controlled by the wagering game machine 302 (client) or the wagering game server 306 (server) in embodiments.

For example, power conservation controls that manage a display screen's light intensity may be managed centrally (e.g., by the wagering game server 306) or locally (e.g., by the wagering game machine 302). Other functionality not directly related to game play may include presentation of advertising, software or firmware updates, system quality or security checks, etc.

In some embodiments, a group 350 of wagering game machines may participate in a multiplayer wagering game controlled by a wagering game server 306. The group may comprise a number of machines arranged as a "bank" of machine that are located near one another, or the group may be distributed across a casino floor. Further, the group may be distributed across casinos. In some embodiments, the multiplayer wagering game is a progressive game in which a portion of the amount wagered at each wagering game machine is placed in a progressive jackpot, causing the jackpot to grow over time. The occurrence of a particular winning outcome at any of the wagering game machines participating in the progressive causes the progressive jackpot to be awarded to the player at the wagering game machine that generated the winning outcome.

In alternative embodiments, the multiplayer wagering game may be a community game in which multiple players may participate in a wagering game or a bonus round of a wagering game. In some embodiments, eligible players begin a community game upon the occurrence of a triggering event. All of the eligible players may participate in the game play, with the progress and outcome of the community game displayed on a display visible to the eligible players, such as an overhead display positioned over a bank of wagering game machines. The eligible players share in any winnings that are provided during the community game.

In some embodiments, an AOM (Administration, Operations and Maintenance) server 307 may be used to configure wagering game machines. For example, AOM server 307 may be used to configure trigger events that trigger a community game or trigger reconfiguration of a wagering game machine. In some embodiments, a "wizard" style interface may be used to configure which events and event parameters trigger community games or wagering game machine reconfiguration. Further, templates may be available on an AOM server and used to configure trigger events. For example, an event template or wizard interface may provide, in table form, the parameters for a triggering event. An example table is as follows:

| Event | Operator | Value | Operation |
|---|---|---|---|
| Credits | >= | 100 | Enable Community Event |

In this example, when the credits on a wagering game machine reach or exceed 100 credits, the machine becomes eligible to participate on the community event. Those of skill in the art will appreciate that other trigger events, operators, values and operations are possible and within the scope of the inventive subject matter.

In some embodiments, configuration changes that are made manually, through configuration on the AOM server 307, or in response to events as described below may be verified at a display coupled to AOM server 307. A display image of a screen of a wagering game machine that has been reconfigured may be transmitted to the AOM server and shown on a display coupled to the AOM server so that an AOM operator may verify that the configuration change has in fact successfully taken place. This is desirable because it avoids the time and expense of forcing a technician to travel to the wagering game machine to manually verify the configuration change has in fact occurred.

Further details on the operation of the wagering game machines and systems described in FIGS. 1-3 are provided below with reference to FIGS. 4-5.

Example Wireless Environment

In some embodiments, the wireless access point 304 can be part of a communication station, such as wireless local area network (WLAN) communication station including a Wireless Fidelity (WiFi) communication station, or a WLAN access point (AP). In these embodiments, the wagering game machines 302 can be part of a mobile station, such as WLAN mobile station or a WiFi mobile station.

In some other embodiments, the wireless access point 304 can be part of a broadband wireless access (BWA) network communication station, such as a Worldwide Interoperability for Microwave Access (WiMax) communication station, as the wireless access point 304 can be part of almost any wireless communication device. In these embodiments, the wagering game machines 302 can be part of a BWA network communication station, such as a WiMax communication station.

In some embodiments, any of the wagering game machines 302 can part of a portable wireless communication device, such as a personal digital assistant (PDA), a laptop or portable computer with wireless communication capability, a web tablet, a wireless telephone, a wireless headset, a pager, an instant messaging device, a digital camera, a television or other device that can receive and/or transmit information wirelessly.

In some embodiments, the wireless access point 304 and the wagering game machines 302 can communicate RF signals in accordance with specific communication standards, such as the Institute of Electrical and Electronics Engineers (IEEE) standards including IEEE 802.11(a), 802.11(b), 802.11(g), 802.11(h) and/or 802.11(n) standards and/or proposed specifications for wireless local area networks, but they can also be suitable to transmit and/or receive communications in accordance with other techniques and standards. In some BWA network embodiments, the wireless access point 304 and the wagering game machines 302 can communicate RF signals in accordance with the IEEE 802.16-2004 and the IEEE 802.16(e) standards for wireless metropolitan area networks (WMANs) including variations and evolutions thereof. However, they can also be suitable to transmit and/or receive communications in accordance with other techniques and standards. For more information with respect to the IEEE 802.11 and IEEE 802.16 standards, please refer to "IEEE Standards for Information Technology—Telecommunications and Information Exchange between Systems"—Local Area Networks—Specific Requirements—Part 11 "Wireless LAN Medium Access Control (MAC) and Physical Layer (PHY), ISO/IEC 8802-11: 1999", and Metropolitan Area Networks—Specific Requirements—Part 16: "Air Interface for Fixed Broadband Wireless Access Systems," Can 2005 and related amendments/versions.

In other embodiments, the wireless access point 304 and the wagering game machines 302 can communicate in accordance with a short-range wireless standard, such as the Bluetooth™ short-range digital communication protocol.

It will be appreciated from the above that various components of a wagering game architecture and/or their functionality may be distributed in various manners. For example, all of the components and functionality may reside in a wagering game machine, or various portions may reside in part on a wagering game machine and in part on a server or other network attached device. The scope of the inventive subject matter is meant to include all of these environments.

Example Operations

Figure 4:
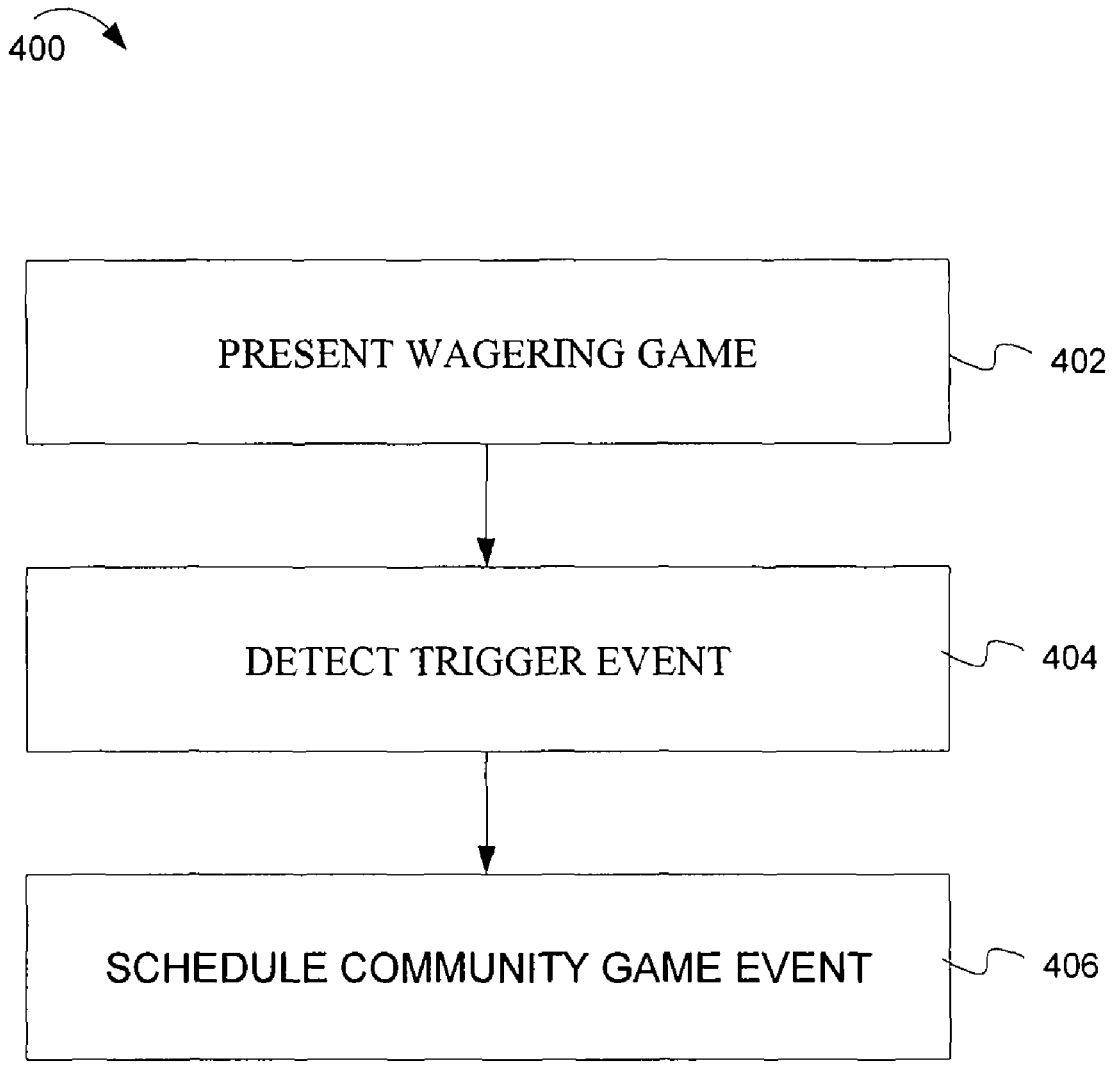
FIG. 4 is a flowchart illustrating generally a method of scheduling a community event based on a triggering event according to embodiments of the invention.
Figure 5:
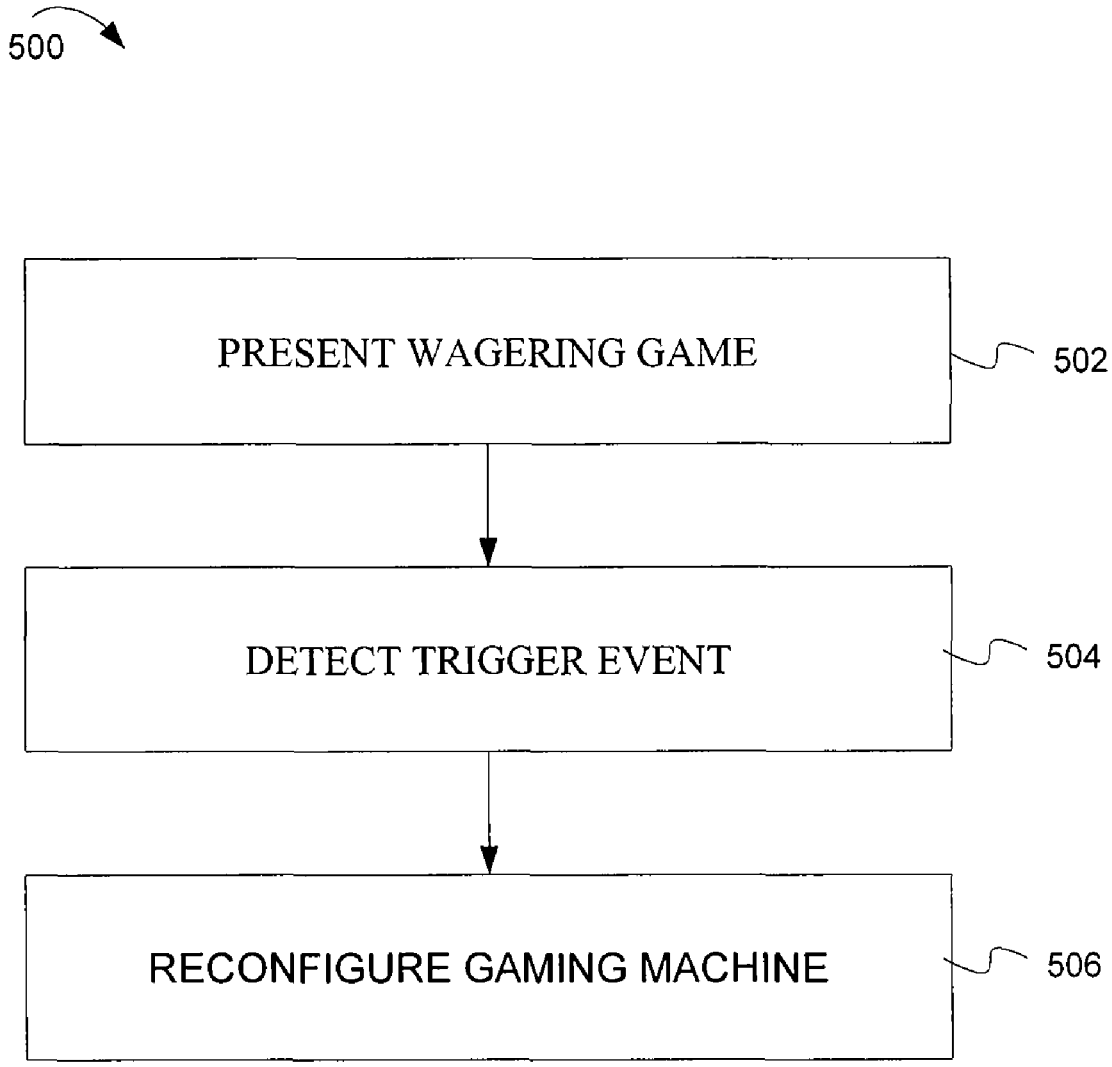
FIG. 5 is a flowchart illustrating generally a method for reconfiguring a wagering game machine according to embodiments of the invention.

FIGS. 4-5 illustrate methods according to embodiments of the invention for scheduling community wagering game events and/or reconfiguring wagering game machines based on trigging events. The methods to be performed by an operating environment such as control system 106 and network system 300 constitute computer programs made up of computer-executable instructions. Describing the methods by reference to a flowchart enables one skilled in the art to develop such programs including such instructions to carry out the method on suitable processors for gaming machines (the processor or processors of the computer executing the instructions from computer-readable media). The methods illustrated in FIGS. 4-5 are inclusive of acts that may be taken by an operating environment executing an exemplary embodiment of the invention.

FIG. 4 is a flowchart illustrating generally a method 400 of scheduling a community event based on a triggering event according to embodiments of the invention. In some embodiments, method 400 begins at block 402 by initiating the presentation of a wagering game upon which monetary value may be wagered. The wagering game may be any type of wagering game such as video versions of a slots, poker, keno, bingo, pachinko, craps or any other type of wagering game. The wagering game may be configured to participate in a multiparty game such as a progressive game or a community game.

At block 404, a trigger event is detected. The trigger event may be an event that occurs on a wagering game machine that is participating in the community game, by an event that is detected by a server providing services related to the community game, or by an external event that occurs outside of a wagering game or community game but is communicated to a server providing services related to the community game.

Events that occur on a wagering game machine that may be a trigger event include random events such as events based on the generation of a random number or the occurrence of a particular symbol on a wagering game machine.

Additionally, events that occur on a wagering game machine that may be a trigger event that is not based on a random event and may cause a community game to start. Such events may include, but are not limited to, various combinations of one or more of the following:

- The passage of configured amount of time.
- Receipt of a configured amount of coin-in.
- The rate of coin-in for the wagering game machine exceeding a predetermined or configured rate.
- The passage of a configured amount of time with no coin-in.
- A jackpot win.
- Number of credits in play exceeding a configured amount.
- Amount of money in the wagering game machine hopper exceeding a configured amount.
- Game play frequency (for example, the number of spins on a slots based game) exceeding a configured amount.
- The actual hold or payback percentage reaching a configured threshold.

Trigger events that may be detected by a server providing services for a community game include one or more of the following:

- Server generated random number.
- Progressive jackpot reaching a threshold.
- Occupancy (or vacancy) reaching a threshold. The occupancy may be based on the occupancy of a group of machines, such as a bank of machines.
- The number of base wagering games currently being played exceeding a configured amount.
- The number of instances of a wagering game that have been played exceeding a configured amount.
- The presence of a particular player or class of player as determined by a player tracking service at a wagering game machine in a bank of machines participating in a community game. For example, a gaming establishment may provide for one or more classes of players based on the frequency of play, number of stays, amount wagered etc.
- The proximity of a particular player or class of players to a wagering game machine in a bank of machines participating in a community game.
- The presence of a configured number of players having a particular class that are playing at a bank of wagering game machines.
- The number of unique logins of players as determined by a player tracking service exceeding a configured amount.
- Coin in for a bank of wagering game machines exceeding a configured amount.
- The failure of a wagering game machine in a bank of machines.
- The number of wagering game machines in a bank where the wagering game has produced a high multiplier.

Other servers or services may provide external data or information that may be used to generate or determine triggering events. Examples of such external data includes, but is not limited to, combinations of one or more of the following:

- Game scores or results for sporting events.
- Results on financial markets.
- Results of political polls.
- Weather data.
- News data.

It should be noted that while the events above have been described as being generated or detected on particular types of servers or on wagering game machines, the events may be generated or detected on any suitably configured machine, server or wagering game machine. For example, in some embodiments, a streak comprising a consecutive series of wins or losses on a wagering game machine that exceed a predetermined or configured number may make the wagering game machine eligible to participate in a progressive or community game. Such event generation and/or detection may take place on a wagering game machine or on a server tracking wins/losses. Further, player tracking information may be used to track wins and losses across multiple wagering game machines such that consecutive wins or losses by a player across multiple wagering game machines may make the player eligible to participate in a progressive or community game.

At block 406, one or more of the triggering events described above with reference to block 404 may be used to trigger the start of a community game.

FIG. 5 is a flowchart illustrating generally a method 500 for reconfiguring a wagering game machine according to embodiments of the invention. In some embodiments, method 500 begins at block 502 by initiating the presentation of a wagering game upon which monetary value may be wagered. The wagering game may be any type of wagering game such as video versions of a slots, poker, keno, bingo, pachinko, craps or any other type of wagering game. The wagering game may be configured to participate in a multi-party game such as a progressive game or a community game.

At block 504, an event is detected. The event may be any combination of one or more of the events described above with reference to block 404 (FIG. 4).

At block 506, a wagering game or wagering game machine is reconfigured upon detection of the event at block 504. Any of the wagering game machine configuration data 214 may be reconfigured. That is, the appearance or "skin" of a wagering game machine or wagering game may be changed; graphics, advertising, bonus graphics, overhead signage etc. may be changed. Additionally, a pay table or denomination data may be changed. The availability of themes, portal games, or services may be changed. For example, the occurrence of an event may cause a theme, bonus game, or portal game or service (email, browser, phone etc.) to become unlocked, that is, made available on the wagering game machine. Further, frequent player rewards may be reconfigured. For example, upon the occurrence of an event at block 504, the player rewards may be multiplied (e.g. doubled).

In addition to wagering game machine data, progressive game data may also be reconfigured in response to an event at block 504. For example, the number of levels in a progressive game, or the reset value (e.g. the initial value of the progressive jackpot following a jackpot win) may be reconfigured in response to a triggering event.

Also, the wagering game machine may be reconfigured to unlock assets such as episodes, themes or other wagering game assets described herein. For example, upon the occurrence of a streak comprising a consecutive series of wins or losses that exceed a predetermined or configured number, a new episode or theme may be unlocked on a wagering game machine.

Example Wagering Game Machines

Example Wagering Game Machine

Figure 6:
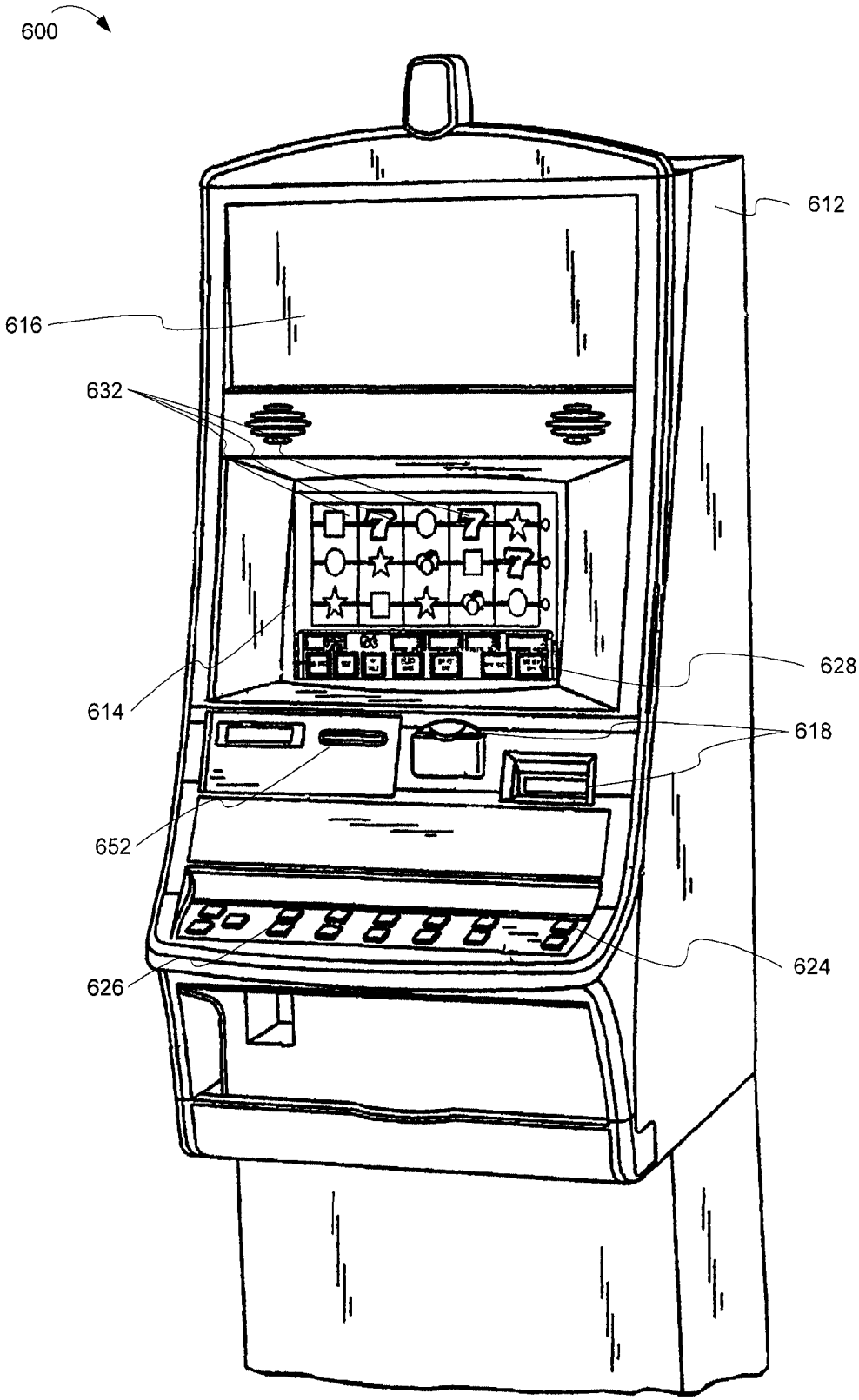
FIG. 6 is a perspective view of a wagering game machine, according to example embodiments of the invention.

FIG. 6 is a perspective view of a wagering game machine, according to example embodiments of the invention. Referring to FIG. 6, a wagering game machine 600 is used in gaming establishments, such as casinos. According to embodiments, the wagering game machine 600 can be any type of wagering game machine and can have varying structures and methods of operation. For example, the wagering game machine 600 can be an electromechanical wagering game machine configured to play mechanical slots, or it can be an electronic wagering game machine configured to play video casino games, such as blackjack, slots, keno, poker, blackjack, roulette, etc.

The wagering game machine 600 comprises a housing 612 and includes input devices, including value input devices 618 and a player input device 624. For output, the wagering game machine 600 includes a primary display 614 for displaying information about a basic wagering game. The primary display 614 can also display information about a bonus wagering game and a progressive wagering game. The wagering game machine 600 also includes a secondary display 616 for displaying wagering game events, wagering game outcomes, and/or signage information. While some components of the wagering game machine 600 are described herein, numerous other elements can exist and can be used in any number or combination to create varying forms of the wagering game machine 600.

The value input devices 618 can take any suitable form and can be located on the front of the housing 612. The value input devices 618 can receive currency and/or credits inserted by a player. The value input devices 618 can include coin acceptors for receiving coin currency and bill acceptors for receiving paper currency. Furthermore, the value input devices 618 can include ticket readers or barcode scanners for reading information stored on vouchers, cards, or other tangible portable storage devices. The vouchers or cards can authorize access to central accounts, which can transfer money to the wagering game machine 600.

The player input device 624 comprises a plurality of push buttons on a button panel 626 for operating the wagering game machine 600. In addition, or alternatively, the player input device 624 can comprise a touch screen 628 mounted over the primary display 614 and/or secondary display 616.

The various components of the wagering game machine 600 can be connected directly to, or contained within, the housing 612. Alternatively, some of the wagering game machine's components can be located outside of the housing 612, while being communicatively coupled with the wagering game machine 600 using any suitable wired or wireless communication technology.

The operation of the basic wagering game can be displayed to the player on the primary display 614. The primary display 614 can also display a bonus game associated with the basic wagering game. The primary display 614 can include a cathode ray tube (CRT), a high resolution liquid crystal display (LCD), a plasma display, light emitting diodes (LEDs), or any other type of display suitable for use in the wagering game machine 600. Alternatively, the primary display 614 can include a number of mechanical reels to display the outcome. In FIG. 6, the wagering game machine 600 is an "upright" version in which the primary display 614 is oriented vertically relative to the player. Alternatively, the wagering game machine can be a "slant-top" version in which the primary display 614 is slanted at about a thirty-degree angle toward the player of the wagering game machine 600. In yet another embodiment, the wagering game machine 600 can exhibit any suitable form factor, such as a free standing model, bartop model, mobile handheld model, or workstation console model.

A player begins playing a basic wagering game by making a wager via the value input device 618. The player can initiate play by using the player input device's buttons or touch screen 628. The basic game can include arranging a plurality of symbols along a payline 632, which indicates one or more outcomes of the basic game. Such outcomes can be randomly selected in response to player input. At least one of the outcomes, which can include any variation or combination of symbols, can trigger a bonus game.

In some embodiments, the wagering game machine 600 can also include an information reader 652, which can include a card reader, ticket reader, bar code scanner, RFID transceiver, or computer readable storage medium interface. In some embodiments, the information reader 652 can be used to award complimentary services, restore game assets, track player habits, etc.

Example Wagering Game Machine

Figure 7:
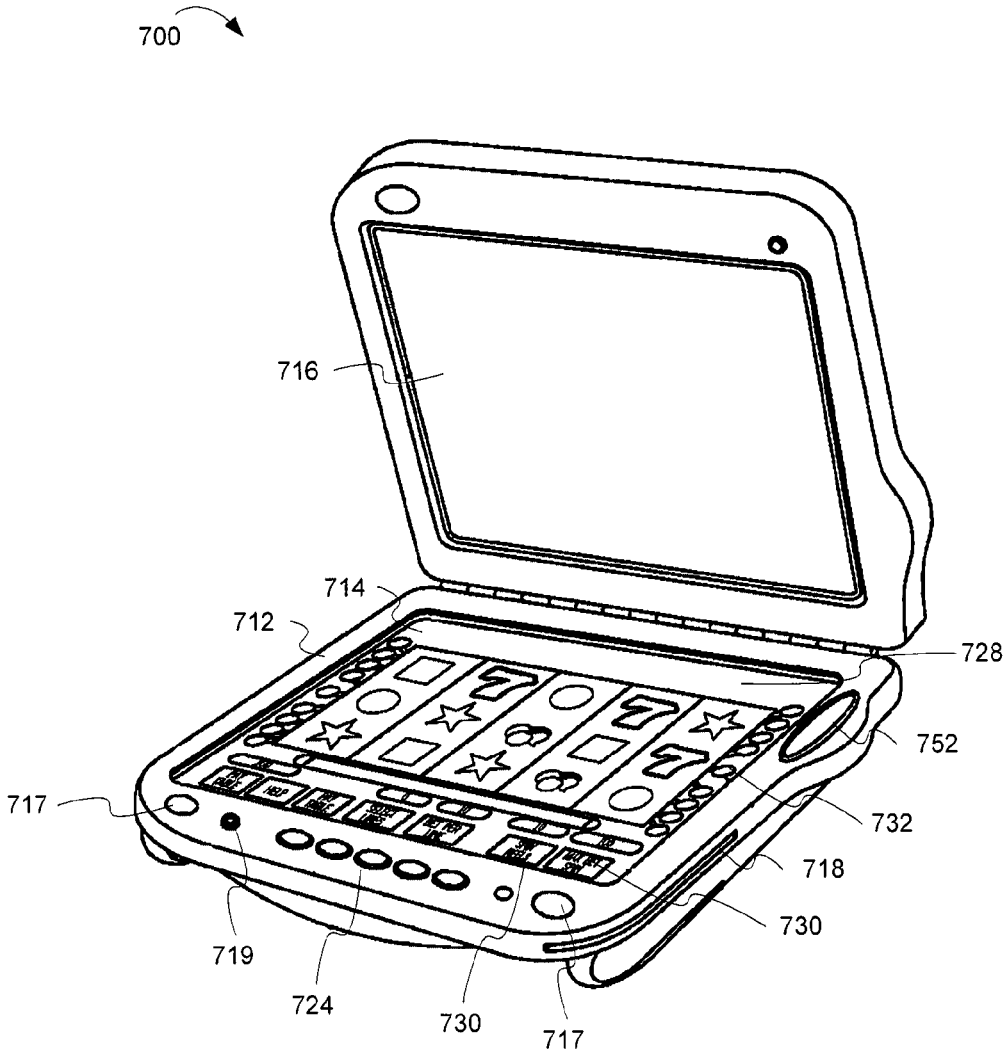
FIG. 7 is a perspective view of a portable wagering game machine, according to example embodiments of the invention.

FIG. 7 shows an example embodiment of a wagering game machine 700. Like free standing wagering game machines, in a handheld or mobile form, the wagering game machine 700 can include any suitable electronic device configured to play a video casino games such as blackjack, slots, keno, poker, blackjack, and roulette. The wagering game machine 700 comprises a housing 712 and includes input devices, including a value input device 718 and a player input device 724. For output, the wagering game machine 700 includes a primary display 714, a secondary display 716, one or more speakers 717, one or more player-accessible ports 719 (e.g., an audio output jack for headphones, a video headset jack, etc.), and other conventional I/O devices and ports, which may or may not be player-accessible. In the embodiment depicted in FIG. 7, the wagering game machine 700 comprises a secondary display 716 that is rotatable relative to the primary display 714. The optional secondary display 716 can be fixed, movable, and/or detachable/attachable relative to the primary display 714. Either the primary display 714 and/or secondary display 716 can be configured to display any aspect of a non-wagering game, wagering game, secondary game, bonus game, progressive wagering game, group game, shared-experience game or event, game event, game outcome, scrolling information, text messaging, emails, alerts or announcements, broadcast information, subscription information, and wagering game machine status.

The player-accessible value input device 718 can comprise, for example, a slot located on the front, side, or top of the housing 712 configured to receive credit from a stored-value card (e.g., casino card, smart card, debit card, credit card, etc.) inserted by a player. The player-accessible value input device 718 can also comprise a sensor (e.g., an RF sensor) configured to sense a signal (e.g., an RF signal) output by a transmitter (e.g., an RF transmitter) carried by a player. The player-accessible value input device 718 can also or alternatively include a ticket reader, or barcode scanner, for reading information stored on a credit ticket, a card, or other tangible portable credit or funds storage device. The credit ticket or card can also authorize access to a central account, which can transfer money to the wagering game machine 700.

Still other player-accessible value input devices 718 can require the use of touch keys 730 on the touch-screen display (e.g., primary display 714 and/or secondary display 716) or player input devices 724. Upon entry of player identification information and, preferably, secondary authorization information (e.g., a password, PIN number, stored value card number, predefined key sequences, etc.), the player can be permitted to access a player's account. As one potential optional security feature, the wagering game machine 700 can be configured to permit a player to only access an account the player has specifically set up for the wagering game machine 700. Other conventional security features can also be utilized to, for example, prevent unauthorized access to a player's account, to minimize an impact of any unauthorized access to a player's account, or to prevent unauthorized access to any personal information or funds temporarily stored on the wagering game machine 700.

The player-accessible value input device 718 can itself comprise or utilize a biometric player information reader which permits the player to access available funds on a player's account, either alone or in combination with another of the aforementioned player-accessible value input devices 718. In an embodiment wherein the player-accessible value input device 718 comprises a biometric player information reader, transactions such as an input of value to the wagering game machine 700, a transfer of value from one player account or source to an account associated with the wagering game machine 700, or the execution of another transaction, for example, could all be authorized by a biometric reading, which could comprise a plurality of biometric readings, from the biometric device.

Alternatively, to enhance security, a transaction can be optionally enabled only by a two-step process in which a secondary source confirms the identity indicated by a primary source. For example, a player-accessible value input device 718 comprising a biometric player information reader can require a confirmatory entry from another biometric player information reader 752, or from another source, such as a credit card, debit card, player ID card, fob key, PIN number, password, hotel room key, etc. Thus, a transaction can be enabled by, for example, a combination of the personal identification input (e.g., biometric input) with a secret PIN number, or a combination of a biometric input with a fob input, or a combination of a fob input with a PIN number, or a combination of a credit card input with a biometric input. Essentially, any two independent sources of identity, one of which is secure or personal to the player (e.g., biometric readings, PIN number, password, etc.) could be utilized to provide enhanced security prior to the electronic transfer of any funds. In another aspect, the value input device 718 can be provided remotely from the wagering game machine 700.

The player input device 724 comprises a plurality of push buttons on a button panel for operating the wagering game machine 700. In addition, or alternatively, the player input device 724 can comprise a touch screen mounted to a primary display 714 and/or secondary display 716. In one aspect, the touch screen is matched to a display screen having one or more selectable touch keys 730 selectable by a user's touching of the associated area of the screen using a finger or a tool, such as a stylus pointer. A player enables a desired function either by touching the touch screen at an appropriate touch key 730 or by pressing an appropriate push button on the button panel. The touch keys 730 can be used to implement the same functions as push buttons. Alternatively, the push buttons 732, can provide inputs for one aspect of the operating the game, while the touch keys 730 can allow for input needed for another aspect of the game. The various components of the wagering game machine 700 can be connected directly to, or contained within, the housing 712, as seen in FIG. 7, or can be located outside the housing 712 and connected to the housing 712 via a variety of wired (tethered) or wireless connection methods. Thus, the wagering game machine 700 can comprise a single unit or a plurality of interconnected (e.g., wireless connections) parts which can be arranged to suit a player's preferences.

The operation of the basic wagering game on the wagering game machine 700 is displayed to the player on the primary display 714. The primary display 714 can also display the bonus game associated with the basic wagering game. The primary display 714 preferably takes the form of a high resolution LCD, a plasma display, an LED, or any other type of display suitable for use in the wagering game machine 700. The size of the primary display 714 can vary from, for example, about a 2-3" display to a 15" or 17" display. In at least some embodiments, the primary display 714 is a 7"-10" display. In one embodiment, the size of the primary display can be increased. Optionally, coatings or removable films or sheets can be applied to the display to provide desired characteristics (e.g., anti-scratch, anti-glare, bacterially-resistant and anti-microbial films, etc.). In at least some embodiments, the primary display 714 and/or secondary display 716 can have a 16:9 aspect ratio or other aspect ratio (e.g., 4:3). The primary display 714 and/or secondary display 716 can also each have different resolutions, different color schemes, and different aspect ratios.

As with the free standing embodiments a wagering gaming machine, a player begins play of the basic wagering game on the wagering game machine 700 by making a wager (e.g., via the value input device 718 or an assignment of credits stored on the handheld gaming machine via the touch screen keys 730, player input device 724, or buttons 732) on the wagering game machine 700. In some embodiments, the basic game can comprise a plurality of symbols arranged in an array, and includes at least one payline 728 that indicates one or more outcomes of the basic game. Such outcomes can be randomly selected in response to the wagering input by the player. At least one of the plurality of randomly selected outcomes can be a start-bonus outcome, which can include any variations of symbols or symbol combinations triggering a bonus game.

In some embodiments, the player-accessible value input device 718 of the wagering game machine 700 can double as a player information reader 752 that allows for identification of a player by reading a card with information indicating the player's identity (e.g., reading a player's credit card, player ID card, smart card, etc.). The player information reader 752 can alternatively or also comprise a bar code scanner, RFID transceiver or computer readable storage medium interface. In one embodiment, the player information reader 752 comprises a biometric sensing device.

General

In this detailed description, reference is made to specific examples by way of drawings and illustrations. These examples are described in sufficient detail to enable those skilled in the art to practice the inventive subject matter, and serve to illustrate how the inventive subject matter can be applied to various purposes or embodiments. Other embodiments are included within the inventive subject matter, as logical, mechanical, electrical, and other changes can be made to the example embodiments described herein. Features or limitations of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments of the invention, which are defined only by the appended claims.

Each of the embodiments described herein are contemplated as falling within the inventive subject matter, which is set forth in the following claims.

What is claimed is:

1. A computer-implemented method of initiating a community game on a gaming system including one or more gaming machines, the method comprising:

receiving, via one or more input devices, an input indicative of a wager to initiate a respective wagering game on each of the one or more gaming machines;

displaying, via one or more display devices, a wagering game on each of the one or more gaming machines;

detecting, via one or more processors, a triggering event that is independent of a game event occurring in any wagering game being displayed on the one or more gaming machines, the triggering event comprising a non-random event associated with an identity of one or more players at the one or more gaming machines; and conducting a community game in response to detecting the triggering event.

2. The method of claim 1, wherein the triggering event comprises the presence of a particular player at one of the one or more gaming machines.

3. The method of claim 1, wherein the triggering event comprises the presence of a particular class of player at at least one of the one or more gaming machines.

4. The method of claim 1, wherein the triggering event further comprises a server detected event.

5. The method of claim 1, wherein the triggering event further comprises the presence of at least a predetermined number of players having at least a predetermined class level at at least the predetermined number of the one or more gaming machines.

6. A computer-implemented method of reconfiguring a gaming machine on a gaming system, the method comprising:

receiving, via one or more display devices, an input indicative of a wager to initiate a respective wagering game on each of the one or more gaming machines;

displaying, via one or more display devices, a wagering game on each of the one or more gaming machines;

detecting, via one or more processors, a triggering event that is independent of a game event occurring in any wagering game being displayed on the one or more gaming machines, the triggering event comprising a non-random event associated with an identity of one or more players at the one or more gaming machines; and reconfiguring a wagering game machine component of at least one of the one or more gaming machines in response to detecting the triggering event.

7. The method of claim 6, wherein the triggering event further comprises a passage of a predetermined amount of time since a designated event.

8. The method of claim 6, wherein the triggering event further comprises a number of game credits on the one or more gaming machines exceeding a predetermined amount.

9. The method of claim 6, wherein the triggering event further comprises a game play frequency at the one or more gaming machines exceeding a predetermined amount.

10. The method of claim 6, wherein the triggering event further comprises an actual hold or actual payback percentage reaching a predetermined threshold on the one or more gaming machines.

11. The method of claim 6, wherein the triggering event further comprises a number of base wagering games being played on the one or more gaming machines exceeding a predetermined amount.

12. A gaming system including a community gaming event, the gaming system comprising:

a community game server communicably connected to one or more gaming machines;

one or more display devices;

one or more input devices;

one or more processors; and one or more memory devices storing instructions that, when executed by at least one of the one or more processors, cause the gaming system to:

receive, via at least one of the one or more input devices, an input indicative of a wager initiating a respective wagering game on each of the one or more gaming machines;

display, via at least one or the one or more display devices, a wagering game on each of the one or more gaming machines;

detect, via at least one of the one or more processors, a triggering event that is independent of a game event occurring in any wagering game being displayed on the one or more gaming machines, the triggering event comprising a non-random event associated with an identity of one or more players at the one or more gaming machines; and initiating, via the community server, a community game in response to detecting the triggering event.

13. The system of claim 12, wherein the triggering event comprises the presence of a particular player at one of the one or more gaming machines.

14. The system of claim 12, wherein the triggering event comprises the presence of a particular class of player at at least one of the one or more gaming machines.

15. The system of claim 12, wherein the triggering event further comprises the presence of at least a predetermined number of players having at least a predetermined class level at at least one of the one or more gaming machines.

16. The system of claim 12, further comprising a server operable to maintain configuration data defining one or more triggering events.

17. The system of claim 16, further comprising a user interface operable to create, read, update or delete portions of the configuration data.

18. A machine-readable, non-transitory medium having machine-executable instructions stored thereon, the instructions, when executed by at least one processor in a gaming system, cause the gaming system to perform a method comprising:

receiving, via one or more display devices, an input indicative of a wager to initiate a respective wagering game on each of the one or more gaming machines;

displaying, via one or more display devices, a wagering game on each of the one or more gaming machines;

detecting, via one or more processors, a triggering event that is independent of a game event occurring in any of wagering game being displayed on the one or more gaming machines, the triggering event comprising a non-random event associated with an identity of one or more players at the one or more gaming machines; and conducting a community game in response to detecting the triggering event.

* * * * *